United States Patent [19]

Takemura et al.

[11] 4,059,440

[45] Nov. 22, 1977

[54] HIGHLY CORROSION RESISTANT FERRITIC STAINLESS STEEL

[75] Inventors: Susumu Takemura; Masao Onoyama; Masanobu Tsuji, all of Hikari, Japan

[73] Assignee: Nippon Steel Corporation, Tokyo, Japan

[21] Appl. No.: 652,703

[22] Filed: Jan. 27, 1976

[30] Foreign Application Priority Data

Feb. 1, 1975 Japan ..... 50-13824

[51] Int. Cl.[2] ..... C22C 38/22; C22C 38/26; C22C 38/28

[52] U.S. Cl. ..... 75/126 C; 75/126 D; 75/126 F; 148/37

[58] Field of Search ..... 148/37; 75/126 C, 126 D, 75/126 F, 126 J

[56] References Cited

U.S. PATENT DOCUMENTS

| | | | |
|---|---|---|---|
| 2,793,113 | 5/1957 | Rait et al. | 75/126 F |
| 3,499,802 | 3/1970 | Lagneborg | 148/37 |
| 3,759,705 | 9/1973 | Chalk | 75/126 F |
| 3,807,991 | 4/1974 | Gregory et al. | 75/126 F |
| 3,852,063 | 12/1974 | Niimi et al. | 75/126 D |
| 3,890,143 | 6/1975 | Skoglund | 75/126 D |
| 3,957,544 | 5/1976 | Pinnow et al. | 148/34 |

FOREIGN PATENT DOCUMENTS

| | | | |
|---|---|---|---|
| 47-9896 | 6/1967 | Japan | 75/126 D |

*Primary Examiner*—Arthur J. Steiner
*Attorney, Agent, or Firm*—Wenderoth, Lind & Ponack

[57] ABSTRACT

A highly corrosion resistant ferritic stainless steel comprising;

C ≦ 0.015%
Si ≦ 0.30%
Mn ≦ 0.30%
P ≦ 0.040%
S ≦ 0.030%
Cr : 18.00 to 25.00%
Ni ≦ 0.20%
Cu ≦ 0.20%
Mo : 1.50 - 3.50%
N ≦ 0.015%
Ti : 4 × (C + N)% to 0.50%, and
Nb : 8 × (C + N)% to 1.00%, wherein
Ti/Nb : 0.5 to 1.2
(Ti + Nb)/(C + N) ≧ 8.0 in case of (C + N) < 0.017%, and
(Ti + Nb)/(C + N) ≦ 16.0 in case of (C + N) ≧ 0.017% with the balance being iron and unavoidable impurities.

1 Claim, 7 Drawing Figures

Results of Sulfuric Acid · Cupper Sulfate Test after A·C at 1200°C for 5 min.

○ △: No Cracking ● ▲: Cracking

HIGHLY CORROSION RESISTANT FERRITIC STAINLESS STEEL

FIELD OF THE INVENTION

The present invention relates to a ferritic stainless steel having excellent corrosion resistance and mechanical properties both in the base metal and the welded portion.

BACKGROUND OF THE INVENTION

Ferritic stainless steels containing no nickel as an alloying element have advantages that their production cost is low and they are free from various types of stress corrosion cracking, but on the other hand have disadvantages that general corrosion resistance is poor and their weldability, corrosion resistance and mechanical properties in welded portions are poor so that they have been restricted in their wide application, particularly their application in the fields such as chemical plants where high degree of material reliability is required. Presently, austenitic stainless steels have been mostly used in these fields, but they have a defect of the susceptibility to stress corrosion cracking so that their reliability in these fields is not enough.

In recent years, several new grades of austenitic stainless steels have been proposed as stress corrosion resistant steels, but most of them do not always show reliable resistance to stress corrosion cracking in actual services although they are immune to cracking in boiling 42% $MgCl_2$ solution.

This is due to the fact that the laboratory test condition in boiling 42% $MgCl_2$ solution is not identical to the actual condition in service. Therefore, great cares have been required in selection of the test condition for development of new corrosion resistant steels, particularly new corrosion resistant steels having satisfactory resistance to stress corrosion cracking. If such cares are not taken, the resultant steels have not practical utility.

The present inventors have conducted studies and development works taking these considerations and have succeeded in development of a novel ferritic stainless steel which is free from any type of stress corrosion cracking, having similar or better corrosion resistance than that of an austenitic stainless steel, and which has eliminated poor weldability and deterioration of corrosion resistance and mechanical properties in welded portions with which the conventional ferritic stainless steels confront inherently.

SUMMARY OF THE INVENTION

The gist of the present invention lies in a corrosion resistant ferritic stainless steel of high reliable and high-purity, which comprises;

$C \leqq 0.015\%$
$S \leqq 0.30\%$
$Mn \leqq 0.30\%$
$P \leqq 0.040\%$
$S \leqq 0.030\%$
Cr : 18.00 to 25.00%
$Ni \leqq 0.20\%$
$Cu \leqq 0.20\%$
Mo : 1.50 to 3.50%
$N \leqq 0.015\%$
Ti : $4 \times (C + N)\%$ to 0.50%
Nb : $8 \times (C + N)\%$ to 1.00% wherein $$Ti/Nb = 0.5 \text{ to } 1.2, \text{ and } (Ti + Nb)/(C + N) \geqq 8.0$$

in case of $C + N < 0.017\%$ $$(Ti + Nb)/(C + N) \geqq 16.0$$

in case of $C + N \geqq 0.017\%$, the balance being iron and unavoidable impurities.

The most important feature of the present invention is the addition of Ti and Nb in combination.

DETAILED DESCRIPTION OF THE INVENTION

The present invention will be described in details referring to the attached drawings.

As is well known, it is effective for improvement of general corrosion resistance of a stainless steel to increase the content of chromium and to add molybdenum.

Figure 1:
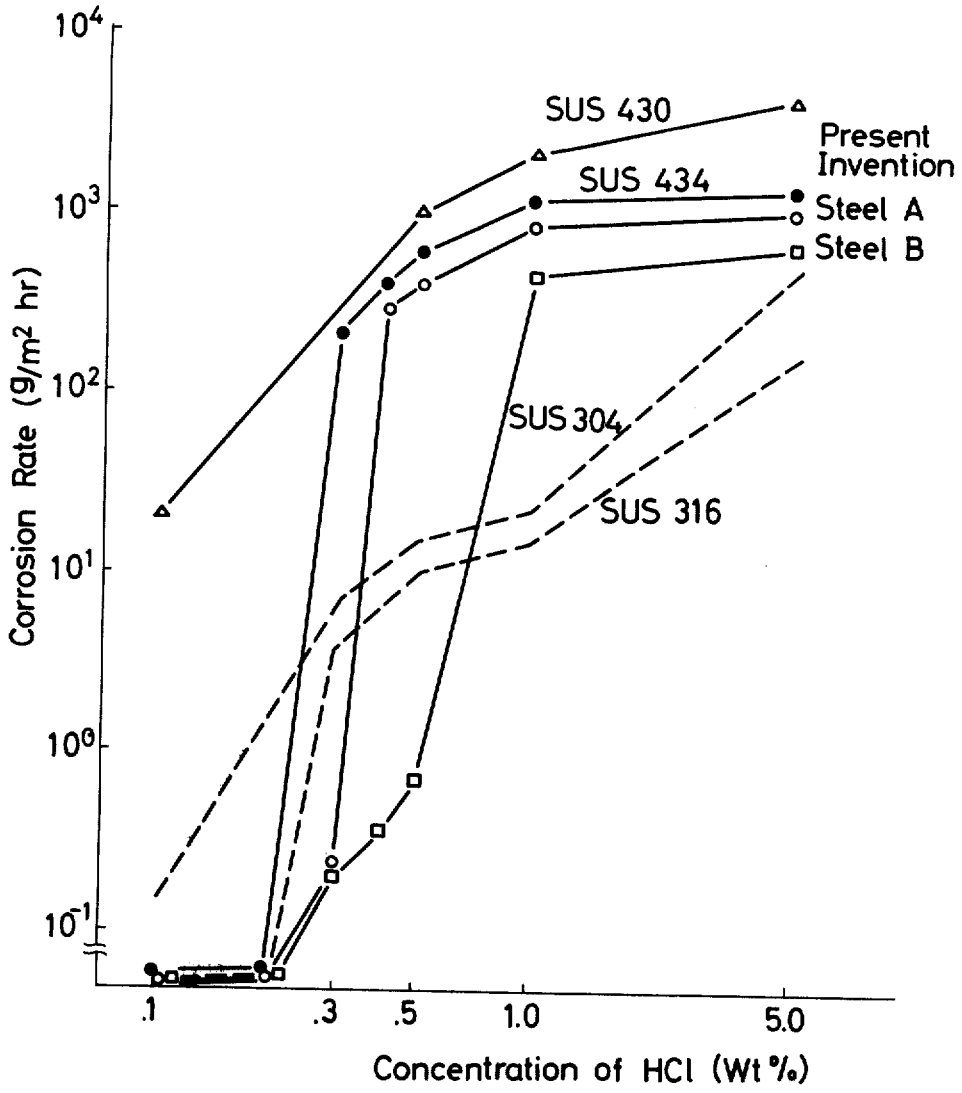
FIG. 1 is a graph showing the corrosion resistances to hydrochloric acid of the stainless steel of the present invention in comparison with that of a conventional similar steel.

The present inventors have found that the addition of molybdenum contributes significantly for improvement of corrosion resistance, particularly in a weak acidic environment (see FIG. 1) and that a 17% Cr - 1% Mo steel shows better corrosion resistance than SUS304 steel when used, for example, in the top of an oil rectifying column.

Figure 2:
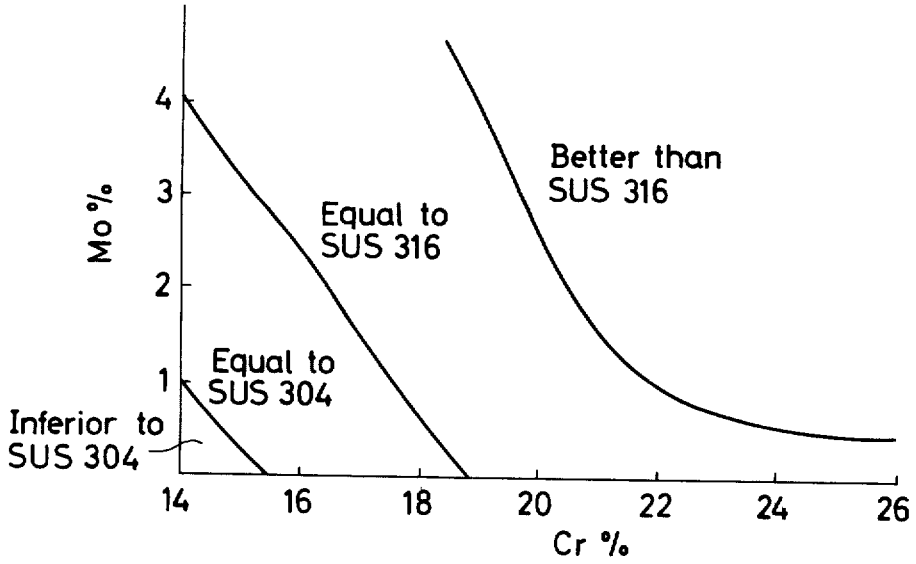
FIG. 2 shows the effects of contents of chromium and molybdenum on the corrosion resistant zone in the hydrochloric acid solution. The corrosion resistant zone has been got by finding the test conditions of the HCl concentration and temperature of the acid solution, on which the lower corrosion rate than 0.1 $g/m^2hr.$, then comparing with that of SUS304 or SUS316.

As clearly understood from FIG. 2, which shows the effect of the molybdenum content on the resistance against hydrochloric acid expressed by the acid solution conditions with a corrosion rate not larger than 0.1 $g/m^2hr.$ compared with that of SUS304 and SUS316. However, even with a chromium content beyond 25% or with a molybdenum content beyond 3.5%, no remarkable expansion of the zone is observed.

Figure 3:
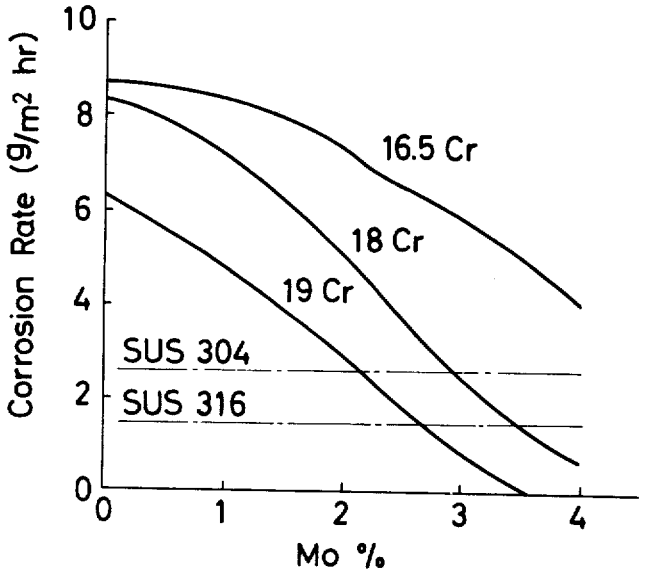
FIG. 3 is a graph showing effects of contents of chromium and molybdenum on the pitting corrosion resistance. (5% $FeCl_3$ + N/20 HCl, 30° C, 48 hrs.)

As seen from FIG. 3 which shows the relationship between the pitting corrosion resistances and the contents of chromium and molybdenum, the pitting corrosion resistance can be improved by increasing the contents of chromium and molybdenum, so that it is possible to combine the chromium content and the molybdenum content in a way to provide similar or better properties as compared with those of SUS304 or SUS316.

For example, a 19Cr - 2 Mo steel and a 18Cr - 3 Mo steel shows better acid resistance, pitting corrosion resistance and rust resistance than those of SUS304 at worst, and in some cases shows similar properties as compared with those of SUS316.

Regarding the corrosion resistance of welded portions, the conventional ferritic stainless steels, SUS430 or SUS434, are very susceptible to coarsening of the ferrite grain and the martensite formation when heated to a temperature higher than about 900° C by welding heat, and at the same time solid dissolution of carbonitrides is caused thereby. When the welded portion is cooled secondary precipitation of the carbo-nitrides is caused at the ferrite grain boundaries or at the ferrite-martensite boundaries so that the steel is readily susceptible to the intergranular corrosion and intergranular stress corrosion cracking even in a very weak corrosive medium, such as a city water.

The above phenomenon is seen also in an austenitic stainless steel, and for its elimination, lowering of the carbon content, and additions of stabilization elements such as titanium and niobium may be considered as an effective measure.

Among these measures, it is very difficult to eliminate the problem of intergranular corrosion cracking by the lowering of carbon and nitrogen content alone. For example, in a 17 - 20% Cr stainless steel, the intergranular corrosion cracking can not be prevented even with a lowered carbon content of 0.001 to 0.002% and a lowered nitrogen content of 0.004 to 0.007%. It is extremely difficult to lower the carbon and nitrogen contents below the above level in a commercial mass production.

Therefore, for prevention of the intergranular corrosion, it is essential to add stabilizing elements.

The object of addition of stabilizing elements is, therefore, to restrict the precipitation of chromium carbide or chromium nitride at the grain boundaries, and for solving this problem it is more reasonable to consider the total of carbon and nitrogen contents than to consider them separately. Therefore, the addition of the stabilizing elements should be expressed by "amount of stabilizing elements/(C + N)" rather than by "Ti/C" or "Nb/C" as used in the austenitic stainless steels.

The addition of Ti or Nb for the purpose of improving the intergranular corrosion resistance has been known in the austenitic stainless steels as SUS321 and SUS347.

In case of ferritic stainless steel, however, the metallurgical principle of their addition in an austenitic stainless steel does not apply at all. This is considered to be due to the difference in the sensitization temperature; the ferritic stainless steel is sensitized during cooling from a high heating temperature, at which the solid-solutions of carbon and nitrogen increase and then their solubilities decrease more than the austenitic steels, so that more than stoichiometrical amount of titanium and niobium is required.

In fact, it is also known in the conventional art to add titanium and niobium as a stabilizing element in a ferritic stainless steel, but in most cases titanium and niobium are not added in combination as in the present invention for the purpose of improvement of properties.

In exceptional cases of the conventional art where both titanium and niobium are added in combination, niobium is considered as mere substitution for titanium and niobium is added in a small amount for substituting part of titanium. This conventional art is based on the technical thought that niobium is almost equal to titanium for the purpose of combining carbon and nitrogen.

Whereas in the present invention more importance is given on niobium which is added for improvement of properties, particularly toughness, and excessive addition of titanium is avoided because it causes surface defects as mentioned hereinafter, and the most important feature of the present invention lies in that a specific proportion for both of the titanium and niobium contents is defined by the Ti/Nb ratio and the ratio is defined as from 0.5 to 1.2 so as to eliminate the surface defects and to improve intergranular corrosion cracking resistance, toughness and ductility in weld metal.

Reason for defining the upper limit of 1.2 for the Ti/Nb ratio is that ductility of the weld metal is required in some cases and such cases it is necessary to add titanium in a relatively large amount. However, excessive addition of titanium causes surface defects in the final product without any advantage. Thus the upper limit of 1.2 is defined as the range free from the surface defect problem.

On the other hand, in cases where the ductility in the welded portion does not cause a problem, a smaller addition of titanium is enough, and it is desirable to maintain the Ti/Nb ratio within a range from 0.5 to 1.0.

Figure 4:
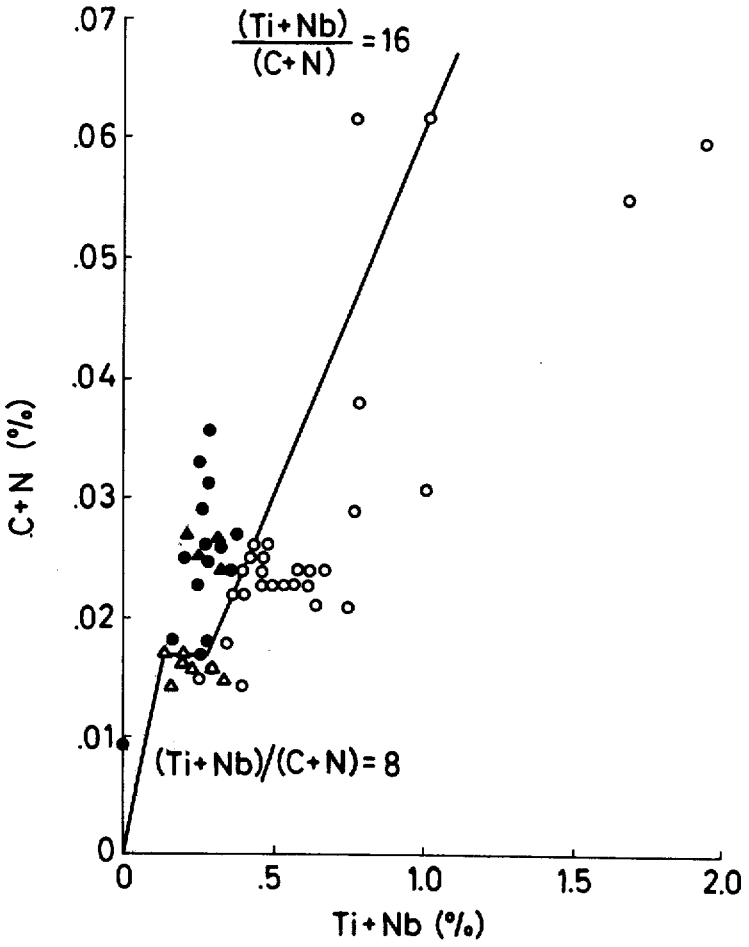
FIG. 4 is a graph showing the intergranular corrosion susceptibility of a sensitized ferritic stainless steel in respect to C + N and Ti + Nb.

The facts found by the present inventors regarding the addition of titanium and niobium are shown in FIG. 4. According to the discovery the addition varies depending on the content of C + N, and it is necessary to satisfy the following conditions.

$$(Ti + Nb) \geqq 8 \times (C + N) \text{ in case of } C + N < 0.017\%$$

$$(Ti + Nb) \geqq 16 \times (C + N) \text{ in case of } C + N \geqq 0.017\%$$

The most important feature of the present invention lies in the above point.

In applications where the corrosive condition is less severe, or the sensitization of the steel during the welding or the cooling after the welding is slight, the addition of titanium and niobium may be smaller, but the high level of reliability as required in chemical plants can not be obtained unless the above conditions are satisfied.

The addition of titanium and niobium in combination as defined in the present invention is based on the results of various experiments set forth below. The basic principle underlying the present invention is that since the stainless steel as directed to by the present invention is to be used for general purposes the welded portion must have similar properties such as corrosion and mechanical properties as those of the base metal. If the welded portion is susceptible to any total defect, a high purity, corrosion resistant stainless steel can not be provided.

The effects of the addition of titanium and niobium on the steel properties are set forth below.

ADDITION OF TI

1. Intergranular corrosion cracking is prevented for the welded portion just as for the base metal.
2. Ductility of the welded portion is improved.
3. Toughness of the welded portion is lowered.
4. Surface defects are caused in the base metal in case of excessive addition.

ADDITION OF NB

Figure 5:
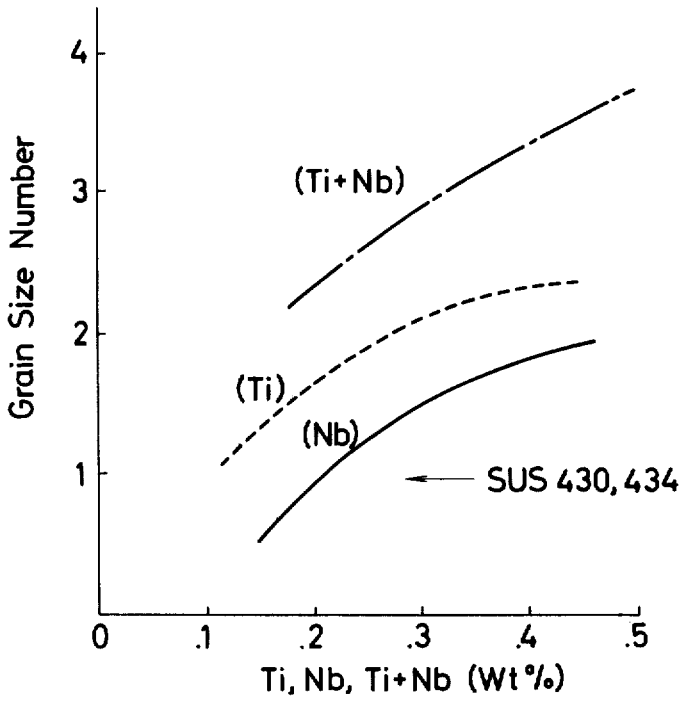
FIG. 5 is a graph showing the relationship between the grain size of the weld metal and the contents of stabilizing elements.
Figure 6:
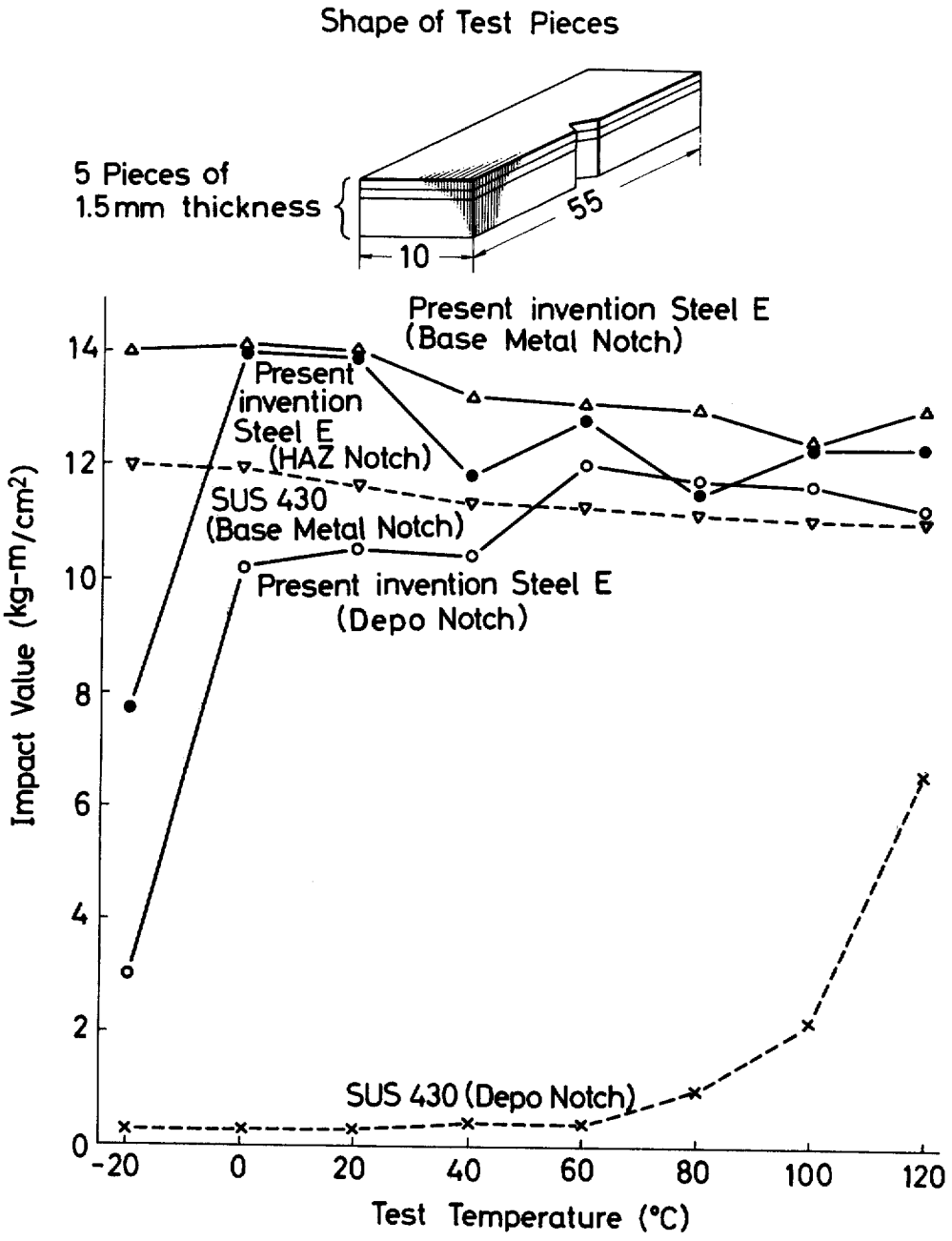
FIG. 6 is a graph showing impact values of the base metal, the heat-affected zone and the weld metal at various temperatures.

1. Intergranular corrosion cracking is prevented for the welded portion just as for the base metal.
2. Ductility of the welded portion is shown in Table 4. With the niobium addition alone, the ductility of the welded portion is for inferior to that of the base metal, although bending property and Erichsen property of the welded portion are improved just as the base metal. These facts correspond well to the grain size in the welded portion shown in FIG. 5. Thus, A weld metal of finer grain size provides better ductility, and this effect is only slight in case of the niobium addition alone, but is very remarkable in case of the niobium and titanium addition in combination.
3. Regarding toughness of the welded portion, the lowering of the content of C + N, as is known, is primarily effective, but in case of a given content of C + N, the embrittle fracture transition temperature is lowered by an appropriate addition of Nb while it is raised by the titanium addition. Whereas, when both titanium and niobium are added in combination, high impact absorption energy and a low embrittle fracture transition temperature without adverse effects by titanium are obtained. This is remarkable improvement as compared with the ductility of the welded portion of the conventional stainless steel SUS430.

4. A stainless steel containing titanium, as is well known, readily absorbs nitrogen during its steel making process, and very susceptible to surface defects due to titanium containing non-metallic inclusions. In order to prevent the above problem, there is nothing but to prevent the nitrogen absorption or to lower the titanium content. As mentioned hereinbefore, however, it is not possible to lower the titanium content unlimitedly in view of the intergranular corrosion resistance. Thus, in this point the addition of niobium in combination with titanium exert its significance. All of the steels shown in examples are free from the surface defect.

Figure 7:
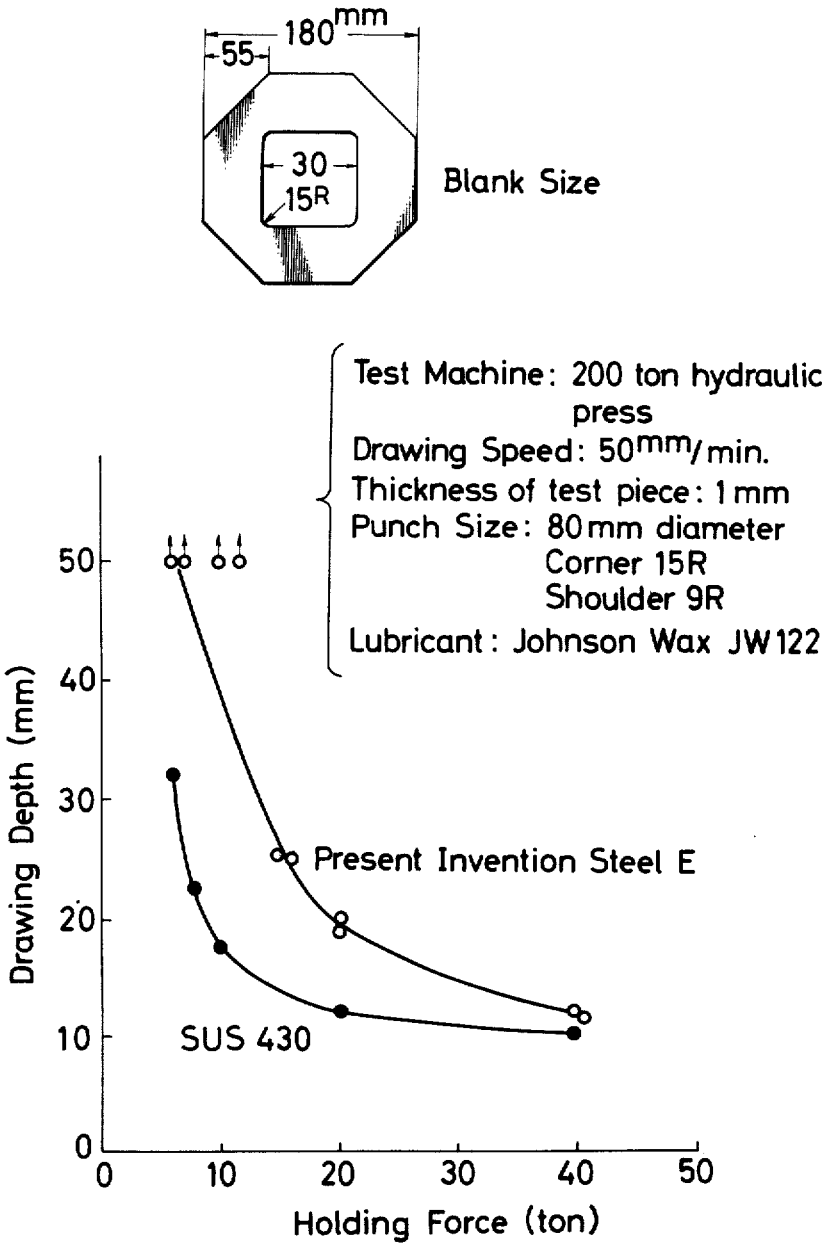
FIG. 7 is a graph showing the deep drawability.

5. The above descriptions are made from the consideration for obtaining improved properties for the welded portion just as for the base metal. It will be necessary to make description from the point of drawability of a thin cold rolled steel sheet. It is conventionally known that addition of titanium is more effective than addition of niobium for improvement of deep-drawability. Also in the present invention, this favourable effect of the titanium addition is maintained and good deep-drawability as shown in FIG. 7 is obtained.

From consideration of the whole effect of individual stabilizing elements on the various properties, as shown in Table 6, excellent properties better than and unexpectable from those obtained by the titanium addition alone or the niobium addition alone can be obtained by the titanium and niobium addition in combination.

6. Ni and/or Cu content must be less than 0.20% for elimination of the susceptibilities of stress corrosion crackings, for example in $Cl^-$ containing solution or acidic hydrogen sulfide solution. Though these points are well-known the present inventors have found the upper limits of these elements in the system of 17 Cr- 1 Mo - Ti.Nb or 19 Cr - 2 Mo - Ti.Nb.

7. The steel according to the present invention remains a ferrite single phase steel under any heat treatment condition due to its main components and high purity. Therefore, contrary to the conventional ferritic stainless steel, the steel of the present invention does not harden and does not show sensitivity to the intergranular corrosion even when it is subjected to a heat history at high temperatures (about 900° C or higher). As for the heat treatment of the final product, 850° to 950° C is generally desirable. In this case, the heat treatment can be done in the same heat treatment furnace as used for the conventional steel, and when higher productivity is desired, it is possible to perform the heat treatment at higher temperatures and in a shorter time. Therefore, the present invention has remarkable advantage over the prior art in respect of production aspect.

Also, due to the addition of titanium, the cold rolled steel sheet produced from the steel of the present invention shows a high level of deep-drawability and ridging property, and shows only very small fluctuation in these properties due to the heat treatment condition, which is otherwise remarkable in the mass-production.

The ferritic steel as hot worked generally shows low toughness and ductility at ordinary temperature. In order to eliminate this defect, the content of C + N should be lowered. However, if the carbon content is maintained at not more than 0.15% and the nitrogen content at not more than 0.015%, for example C + N = 0.012% as in the steel of the present invention, and still the steel as hot worked is susceptible to embrittlement fracture when impact is given, cooling after the hot working should be done slowly when the cross sectional dimention is large. These restrictions are common to all of the conventional ferritic stainless steels and are not peculiar to the steel of the present invention, and do not hinder the mass-production of the stainless steel of the present invention at low cost.

Chromium is a main element which increases corrosion resistance, and as chromium increases the corrosion resistance increases as shown in FIG. 2.

However, excessive addition of chromium will cause lowering of toughness so that there are caused difficulties in production. Thus the upper limit of chromium is set at 25.00%.

Molybdenum, similar as chromium, improves corrosion resistance. Molybdenum contents beyond 3.5% do not give any additional effects, and thus the range from 1.50 to 3.50% has been set for molybdenum.

Carbon and nitrogen are elements which deteriorates intergranular corrosion resistance, but their adverse effect can be prevented by addition of titanium and niobium. However, excessive contents of carbon and nitrogen require increased addition of titanium and niobium, so that cleanness of the steel is lowered and deterioration of toughness in the welded portion is caused. Therefore, it is desirable that carbon and nitrogen contents are maintained at their commercially attainable levels, thus not larger than 0.015% and not larger than 0.015% respectively, and it is more desirable that they are maintained as low as possible.

Titanium and niobium are elements effective to improve the intergranular corrosion resistance and properties of the welded portion, and their required contents depend on the contents of carbon and nitrogen. For exemption from the intergranular corrosion and intergranular stress corrosion cracking, the following conditions must be satisfied:

$(Ti + N) \geqq 8 \times (C + N)$ in case of $C + N < 0.017\%$, and
$(Ti + Nb) \geqq 16 \times (C + N)$ in case of $C + N > 0.017\%$.

Further, titanium and niobium should be added in combination with Ti/Nb ratio from 0.5 to 1.2.

Therefore, the lower limits for titanium and niobium have been set as not lower than four times of C + N and not lower than eight times of C + N respectively.

On the other hand, excessive addition of titanium and niobium deteriorate the cleanness of the steel and the toughness. Therefore, the upper limits of titanium and niobium have been set as not larger than 0.50%, and not larger than 1.00%. When the carbon content is not larger than 0.015% and the nitrogen content is not larger than 0.015%, both titanium and niobium can satisfy the above conditions.

Regarding silicon and manganese, selection of starting materials and strong decarburization are necessary from the point of commercial steel making process so as to maintain both silicon and manganese contents at 0.30% or lower. If these elements are to be re-added in a form of alloy, the harmful carbon and nitrogen contents increase to produce adverse effects on all of the steel properties and require complicated control of addition of stabilization elements. When metallic silicon and metallic manganese, for example, are added for the purpose of avoiding increase of the carbon and nitrogen contents, this causes increased steel production cost and hinders the object to provide a steel for general use.

From the reasons set forth above, both the silicon and manganese contents are limited to 0.30% or lower.

Regarding nickel and copper, it is known that a ferrite stainless steel is sensitive to stress corrosion cracking when it contains nickel and copper. According to the results of stress corrosion cracking tests in boiling 42% $MgCl_2$ solution and in acidic solution of hydrogen sulfide, and various tests in actual plants, it has been found that when 0.5% nickel is contained in the steel of the present invention sensitivity to cracking appears, while when 0.21% nickel is contained no such sensitivity appears.

Similar tendencies are considered to appear in case of copper also, and thus the upper limit of the copper content has been set at 0.20%. Both of nickel and copper are limited within an impurity range, and it is necessary that these elements are maintained at 0.2% or lower, respectively.

Regarding impurities such as phosphorus and sulfur, these elements may be present at a similar level as seen in the conventional stainless steels SUS430 and SUS434, because there is no substantial effects caused on the corrosion resistance and mechanical properties of the base metal and the welded portion when the contents of these elements are changed over their conventional ranges.

There is no specific limitation on the production method of the ferritic stainless steel of the present invention, and conventional arts for steel-making and treatment such as rolling and heat treatments may be applied.

The present invention will be more clearly understood from the following example.

EXAMPLE

Table 1 shows steel compositions within the scope of the present invention and their corrosion resistance at the welded portion in comparison with those of some conventional steel compositions.

As for the testing methods, JIS sulfuric acid-copper sulfate test was used for the intergranular corrosion test, and tests in $H_2SO_4$-acidified solution, or HCl-acidified, $H_2S$-saturated solution at high temperature and high pressure were used for the intergranular stress corrosion cracking test.

The first test is widely used for detecting the intergranular corrosion susceptibility of an austenitic stainless steel, and is also applicable to a ferritic stainless steel although its condition is somewhat severe. Rather, if the test piece passes this severe sulfuric acid-copper sulfate test, the steel can be safely regarded that it has better intergranular corrosion resistance than that of an austenitic stainless steel. The latter test, a high temperature, high pressurized and $H_2SO_4$-acidified solution test, provides conditions contemplated in many environments such as steam heat exchangers and condensors for naphtha cracking.

All of the convention ferritic stainless steels set forth in Table 1 are attached when they are subjected to 1200° C heat treatment which is contemplated to take place during welding, while the steels containing titanium and niobium according to the present invention are free from the corrosion.

Table 2 shows results of the stress corrosion cracking test in a neutral high temperature and high pressurized water containing chloride ions, and Table 3 shows results of tests on stress corrosion cracking due to hydrogen sulfide very often seen in oil refining plants and puls making plants. All of the conventional austenitic stainless steels, when treated by a solid solution treatment or by a sensitization treatment, show sensitivity to cracking, and the conventional ferritic stainless steels show more sensitivity to cracking than the austenitic stainless steel when they are in a sensitized condition, although they are exempt from the cracking when they are in annealed condition. Whereas the ferritic stainless steels containing titanium and niobium according to the present invention are exempt from the cracking when they are in an annealed condition or in a sensitized condition.

Table 4 shows the mechanical properties of the welded portion. The conventional steels show coarsening of the ferrite grains by a high temperature heating of 1200° C or higher and formation of the austenite phase.

When titanium and niobium are added, no austenite phase is formed and the coarsening of the ferrite grains are suppressed so that ductility of the welded portion is improved. Also, the properties of the welded joints of the steel E according to the present invention are shown in Table 5.

Table 1

| | Intergranular Corrosion Resistance and Intergranular Stress Corrosion Cracking Resistance | | | | | | | | |
|---|---|---|---|---|---|---|---|---|---|
| | Chemical Composition (Weight %) | | | | | | | | |
| Steel Grades | C | Si | Mn | P | S | Ni | Cu | Cr | Mo |

Table 1-continued

| | Intergranular Corrosion Resistance and Intergranular Stress Corrosion Cracking Resistance | | | | | | | | |
|---|---|---|---|---|---|---|---|---|---|
| SUS 430 | 0.060 | 0.60 | 0.45 | 0.023 | 0.006 | 0.15 | 0.05 | 16.49 | — |
| SUS 434 | 0.050 | 0.51 | 0.46 | 0.024 | 0.008 | 0.16 | 0.06 | 16.51 | 1.03 |
| 20Cr-2Mo-Ti | 0.007 | 0.11 | 0.10 | 0.009 | 0.007 | 0.08 | 0.02 | 20.19 | 2.14 |
| 19Cr-2Mo-Nb | 0.010 | 0.12 | 0.20 | 0.019 | 0.010 | 0.09 | 0.02 | 18.96 | 2.10 |
| Present Invention Steel A | 0.004 | 0.15 | 0.20 | 0.019 | 0.010 | 0.07 | 0.03 | 19.32 | 2.06 |
| Present Invention Steel B | 0.004 | 0.11 | 0.20 | 0.019 | 0.010 | 0.07 | 0.03 | 18.87 | 2.07 |
| Present Invention Steel C | 0.011 | 0.14 | 0.20 | 0.020 | 0.010 | 0.08 | 0.04 | 17.96 | 2.10 |
| Present Invention Steel D | 0.007 | 0.12 | 0.15 | 0.029 | 0.007 | 0.14 | 0.06 | 18.80 | 2.07 |
| Present Invention Steel E | 0.008 | 0.09 | 0.17 | 0.026 | 0.007 | 0.12 | 0.06 | 18.95 | 2.05 |
| SUS 304 | 0.05 | 0.69 | 1.03 | 0.026 | 0.008 | 8.91 | 0.29 | 18.35 | — |
| SUS 316 | 0.06 | 0.71 | 1.00 | 0.019 | 0.008 | 13.15 | 0.35 | 16.80 | 2.34 |

| Steel Grades | Chemical Composition (Weight %) | | | | | Intergranular Corrosion(*) | | Stress Corrosion Cracking at High Temperature and High Pressure (**) |
|---|---|---|---|---|---|---|---|---|
| | Ti | Nb | N | Ti/Nb | Ti+Nb/C+N | Corrosion Rate ($g/m^2hr$) | Inter-granular cracking | |
| SUS 430 | — | — | — | — | — | 3.62 | YES | Intergranular Cracking |
| SUS 434 | — | — | — | — | — | 3.25 | " | " |
| 20Cr-2Mo-Ti | 0.19 | — | 0.011 | — | 10.5 | 0.44 | " | " |
| 19Cr-2Mo-Nb | — | 0.33 | 0.014 | — | 13.8 | 0.25 | " | " |
| Present Invention Steel A | 0.09 | 0.16 | 0.011 | 0.56 | 16.7 | 0.065 | NO | No cracking |
| Present Invention Steel B | 0.12 | 0.20 | 0.011 | 0.6 | 21.3 | 0.035 | " | " |
| Present Invention Steel C | 0.17 | 0.31 | 0.013 | 0.55 | 20.0 | 0.033 | " | " |
| Present Invention Steel D | 0.37 | 0.32 | 0.011 | 1.16 | 38.4 | 0.020 | " | " |
| Present Invention Steel E | 0.15 | 0.27 | 0.009 | 0.56 | 30.5 | 0.020 | " | " |
| SUS 304 | — | — | — | — | — | — | — | — |
| SUS 316 | — | — | — | — | — | — | — | — |

(*)As annealed at 1200° C for 5min. then air cooled. Sulfuric Acid-Copper Sulfate Corrosion Test (JIS G 0575)
(**)As annealed at 1200° C for 5min. then air cooled.
$H_2SO_4$ is added to high purity water of $1 \times 10^6 \Omega cm$ to adjust pH to 3.9
Initially dissolved oxygen: 8 ppm
300° C 85 atm 100hr × 3 periods
Shape of test piece: 1' × 15" × 100' 10RU bended and restricted Table 2

Stress Corrosion Cracking at High Temperature and High Pressure

| | As Annealed | | | | As Sensitized | | | |
|---|---|---|---|---|---|---|---|---|
| | $Cl^-$ 30 ppm | | $Cl^-$ 600 ppm | | $Cl^-$ 30 ppm | | $Cl^-$ 600 ppm | |
| SUS 304 | O | O | X | X | X | X | X | X |
| Present Invention Steel A | O | O | O | O | O | O | O | O |
| Steel C | O | O | O | O | O | O | O | O |

Condition of Sensitization
SUS 304 650° C 2 hr AC
Others 1200° C 5 min AC
Test Piece 1.5' × 15" × 100' mm, 1OR, U-bended and restricted
Test Solution Pure Water + $Na_2Cl$($Cl^-$ = 30 or 600 ppm) 300° C 87 $Kg/cm^2$ 300 hr
Estimation X Cracking , O No Cracking Table 3

Stress Corrosion Cracking in Hydrogen Sulfide Solution

| | As Annealed | | As Sensitized | |
|---|---|---|---|---|
| SUS 304 | X | X (180 μ) | X | X (130 μ) |
| SUS 434 | O | O | X | X (380 μ) |
| Present Invention A Steel | O | O | O | O |
| Invention C Steel | O | O | O | O |

Heat Treatment and Test Piece are same as in Table 2.
Test Solution: Aqueous Solution having pH value of 3.0 with addition of hydrochloric acid, continuously blown with $H_2S$ gas or 80° C for 15 days.
Estimation : X Cracking , the figures in parentheses represent the maximum crack depth
O No cracking Table 4

Effect of Stabilization Element on Mechanical Properties of Welded Portions

| Steel Grades | Treating Conditions | Tensile Strength δB($Kg/mm^2$) | El(%) | Bending Test 180° U R=1' | R=0.5' | R=O' | Erichsen Value (Plate thickness 2 mm) |
|---|---|---|---|---|---|---|---|
| 19Cr-2Mo-Nb | Annealing A | 51.0 | 33.8 | O | O | O | 11.62 |
| | HAZ equivalent S* | 50.0 | 21.0 | X | X | X | 5.31 |
| | Welded portion W** | 52.0 | 27.0 | 0 | 0 | 0 | 6.92 |
| Present invention B Steel | A | 47.9 | 34.8 | O | O | O | 12.02 |
| | S | 47.5 | 33.0 | O | O | O | 11.12 |
| | W | 49.8 | 31.3 | O | O | O | 11.28 |
| Present invention C Steel | A | 51.2 | 30.5 | O | O | O | 12.21 |
| | S | 46.4 | 29.5 | O | O | O | 11.28 |
| | W | 51.6 | 29.5 | O | O | O | 11.51 |

*Heat treatment condition equivalent to that of welding heat affected zone: 1200° C 5min AC
**Welding condition: TIG welded without filler 70A, 10V, 10 cpm Ar gas(10l/min) shielded Table 5

Properties of Weld Joints (Present Invention Steel E)

| Plate Thickness | Welding Condition: Current A | Speed cpm | Shield gas l/min | Back gas l/min | Tensile Test: δB kg/mm² | Front Back El % | Bending Test: Erichsen Value Side | Side | mm (n=3) | |
|---|---|---|---|---|---|---|---|---|---|---|
| .0 | 70 | 50 | $Ar_{10}$ | — | 52.3 | 30.5 | no cracking at adhesion | no cracking at adhesion | 9.96/10.48 | 10.18 |
| | 40 | 20 | 15 | $Ar_5$ | 50.8 | 14.5 | " | " | 6.98/9.67 | 8.06 |
| | 80 | 60 | 15 | " | 45.7 | 15.8 | " | " | 7.15/7.26 | 7.23 |
| ..0' Base Metal | — | — | — | — | 52.0 | 31.3 | " | " | 10.56/10.92 | 10.62 |
| 1.5 | 70 | 20 | 15 | 5 | 50.3 | 16.0 | " | " | 8.00/8.75 | 8.36 |
| | 90 | 20 | 15 | 5 | 47.2 | 10.0 | " | " | 8.68/9.75 | 9.19 |
| | 140 | 60 | 15 | 5 | 50.6 | 22.0 | " | " | 9.33/9.45 | 9.37 |
| 1.5' Base Metal | — | — | — | — | 51.2 | 33.5 | " | " | 11.08/11.38 | 11.19 |

Remarks 1) TIG But Welding : without filler (no flyer)
Tensile Test : JIS 13-B C-direnction welding, R.D. (Roll Direction) tension Table 6

Effects of Stabilization Elements

| Stabilization Elements | Surface Defects | Properties of Welded Portion: Intergranular Corrosion Resistance | Ductility | Toughness | General Estimation |
|---|---|---|---|---|---|
| Ti | X | O | Δ | X | X |
| Nb | O | O | X | O | X |
| Ti+Nb | O | O | O | O | O |

(The stabilization elements are added in an amount enough to assure the intergranular corrosion resistance of the welded portion.)
O: well usable in the wide application
Δ: usable only under limited conditions
X: no usable

What is claimed is:

1. A stable, highly corrosion resistant single phase ferritic stainless steel consisting essentially of the following components:

C ≦ 0.015%
Si ≦ 0.30%
Mn ≦ 0.30%
P ≦ 0.040%
S ≦ 0.030%
Cr : 18.00 to 25.00%
Ni ≦ 0.20%
Cu ≦ 0.20%
Mo : 1.50 – 3.50%
N ≦ 0.015%
Ti : 4 × (C + N)% to 0.50%, and
Nb : 8 × (C + N)% to 1.00%, wherein
Ti/Nb : 0.5 to 1.2
(Ti + Nb)/(C + N) ≧ 8.0 in case of (C + N) < 0.017%, and
(Ti + Nb)/(C + N) ≧ 16.0 in case of (C + N) ≧ 0.017% with the balance being iron and unavoidable impurities.

* * * * *